US006859982B1

(12) United States Patent
Carrillo

(10) Patent No.: US 6,859,982 B1
(45) Date of Patent: Mar. 1, 2005

(54) CONNECTOR

(76) Inventor: Mario R. Carrillo, 13727 Kinbrook St., Sylmar, CA (US) 91342

( * ) Notice: Subject to any disclaimer, the term of this patent is extended or adjusted under 35 U.S.C. 154(b) by 4 days.

(21) Appl. No.: 10/388,003

(22) Filed: Mar. 13, 2003

(51) Int. Cl.[7] ..... A44B 11/25; A44B 21/00

(52) U.S. Cl. ..... 24/584.1; 24/310; 24/586.11; 24/578.14; 24/587.1; 24/590.1; 24/593.1

(58) Field of Search ..... 24/584.1, 586.11, 24/587.1, 589.1, 590.1, 684, 685, 591.1, 578.1, 593.1, 682.1, 652, 265 B; 16/366, 258, 302, 266; 351/153

(56) References Cited

U.S. PATENT DOCUMENTS 2,956,324 A * 10/1960 Klein ..... 24/323
3,253,842 A * 5/1966 Rabe ..... 24/593.1
3,372,440 A * 3/1968 Burson, Jr. ..... 24/310
3,520,033 A * 7/1970 Usuda ..... 24/590.1
3,570,078 A * 3/1971 Neumann et al. ..... 24/652
4,000,544 A * 1/1977 Fildan ..... 24/578.14
4,008,513 A * 2/1977 Griffiths ..... 24/587.1
4,161,806 A * 7/1979 Hennisse et al. ..... 24/586.11
4,581,910 A * 4/1986 Brooks et al. ..... 24/576.1
5,377,394 A * 1/1995 Fildan ..... 24/587.1

* cited by examiner

*Primary Examiner*—Victor Sakran
(74) *Attorney, Agent, or Firm*—Henry M. Bissell

(57) ABSTRACT

The present invention provides a connector for releasable joining of two ends of material. The invention involves two generally symmetrical connector halves which engage with one another to maintain a connection capable of resisting opposing tension forces. A spring-force ball and socket arrangement is incorporated in each body half to maintain a secure connection. Rotatable interlocking tongue-and-groove structures provide ease of use and effective resistance to tension forces.

17 Claims, 2 Drawing Sheets

CONNECTOR

BACKGROUND OF THE INVENTION

1. Field of the Invention

The present invention generally relates to connecting devices and more particularly to connectors such as those used for fastening and securing belts, webbing, straps, animal collars and similar and related applications.

2. Description of the Related Art

A wide variety of two-piece connectors have been devised for use in securing together the ends of a length of material. Frequently, such connectors are made of metal or plastic, even a combination thereof. In recent years, black ABS plastic connectors have become almost ubiquitous in their use on backpacks and luggage. Such connector devices consist of two pieces, one male and a corresponding female, for interlocking and retention. Successful connection of the two pieces is usually achieved through the deployment of barbed spring members, which engage openings in the opposing connector piece.

Such existing connectors have the inherent disadvantage of requiring the manufacture of separate distinct bodies for both male and female connector halves.

SUMMARY OF THE INVENTION

The connector of the present invention employs the locking interaction of a series of tongue-and-groove structures to provide a simple, ingenious, innovative and convenient closure mechanism. One embodiment of the present invention is a connector providing, when closed, a smooth unitary appearance, with clean and uninterrupted lines. Opposing rotational forces may be applied to the ends of the connector in order to open the connector and enable separation of its component halves.

The connector halves may be fastened together in the following manner. The respective body halves of the connector may be properly fitted together and, with the imparting of a rotational motion to one half relative to the other, full closure of the connector may be secured.

The cooperation of a spring-loaded captive ball or pin arrangement and a corresponding receiver socket serves to maintain the connector in a closed position.

A cylindrical pin projects from one connector body half, axially aligned with the central longitudinal axis of the connector body. The other connector body half is adapted to receive the cylindrical pin within a corresponding bore, also axially aligned with the central longitudinal axis of the connector body.

To fasten the connector, the pin of one body half is inserted into the corresponding bore of a second body half. Then the two body halves are rotated opposite one another until the spring-loaded captive ball assembly of each body half is brought into cooperation with the receiver socket of the other body half, to maintain secure closure of the connector.

As the connector body halves are rotated relative to each other, formed knuckles on each body half engage with gaps or passages between the knuckles on the other body half. The knuckles and gaps engage as tongue-and-groove structures to provide resistance to longitudinal tensioning forces.

The knuckle and passage structures are generally planar in profile and oriented generally perpendicular to the longitudinal axis of the connector.

One half of the knuckles and passages of each connector body half have a section of the generally planar surface shaped to trend toward a curved surface approaching a leading edge. This enables the corresponding knuckles and passages to rotate and engage each other in an interlocking fashion. Each connector body half is identical but for the presence of the cylindrical pin or the defined cylindrical bore located along the central longitudinal axis of the engaging end of the body half. This high degree of structural similarity enables the connector of the present invention to be manufactured at lower cost and provides for more efficient use of materials.

To maintain the connector of the present invention in its closed and fastened configuration, a spring-tensioned captive ball or pin arrangement and a corresponding receiver socket or dimple is incorporated into the design. This captive ball or pin assembly is spring-loaded and adapted to engage with a corresponding dimple or socket defined in the mating face of the corresponding body half. The spring force may be increased or decreased by varying the type of spring or its degree of compression. Varying the spring force serves to vary the amount of rotational force necessary to open or close the connector. Variations in the size and shape of the ball or pin and the receiving dimple or socket may also be used to achieve the desired closure force.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

The present invention is generally related to a connector for releasably coupling together two components. The present invention relates more particularly to an interlocking two-piece connector device, for releasably securing together the ends of a length, or two lengths, of strap material, webbing, line or similar items. While the illustrated preferred embodiment is described below in terms of a connector mechanism for releasably securing together two ends of a length of a strap material, equivalent materials such as nylon webbing, leather, fabric, cord, line, chain, or rope are contemplated as falling within the scope of this disclosure.

Generally, the present invention provides a means for releasably fastening together the ends of a strap, or connecting two straps. The utility of such an invention is readily apparent for use in conjunction with animal collars and leads, belts, jewelry, bracelets, necklaces and the like.

Figure 1:
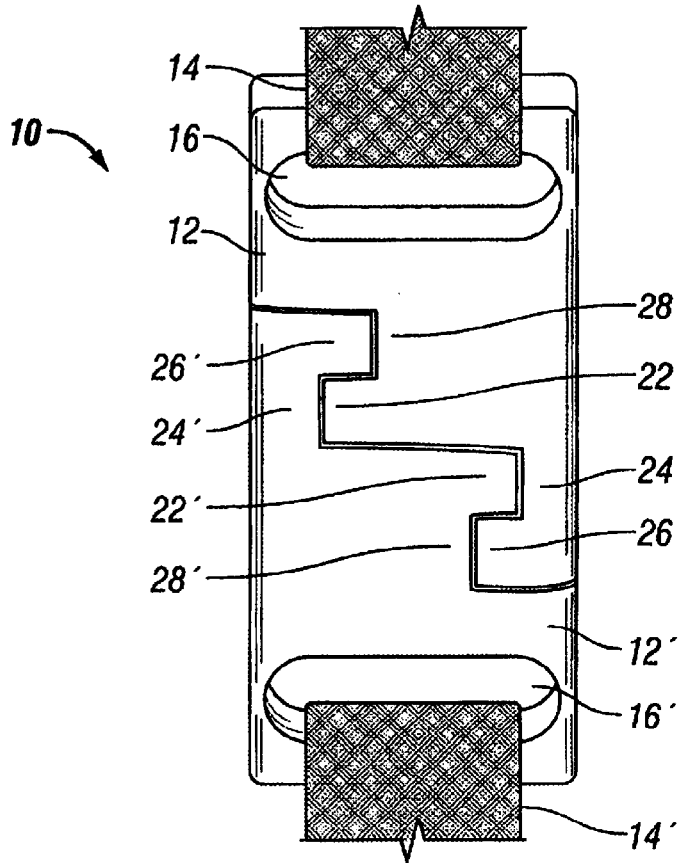
FIG. 1 is a plan view of a closed connector in accordance with one embodiment of the present invention.
Figure 2:
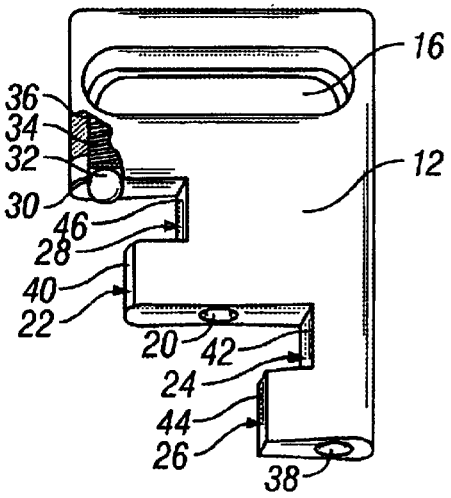
FIG. 2 is a perspective view of a first body half of the connector of FIG. 1.
Figure 3:
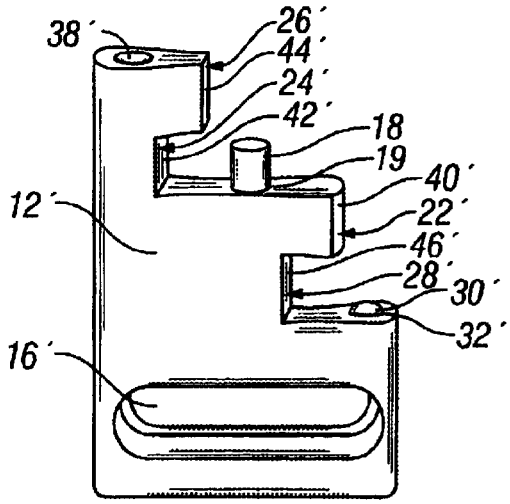
FIG. 3 is a perspective view of a second body half of the connector of FIG. 1.

Referring now to FIGS. 1–3, the connector 10 is shown including two connector body halves 12 and 12'. Each connector body half 12 and 12' defines an attachment opening 16 and 16' for receiving strap ends 14 and 14'.

Connector body half 12' (FIG. 3) defines a pin securing bore 19 for securely retaining a pin 18. Connector body half 12 (FIG. 2) defines a pin receiving bore 20 for receiving pin 18 of connector body half 12'. Pin 18 and pin receiving bore 20 are axially aligned with the central longitudinal axis of connector 10.

The two connector body halves 12, 12' have proximal knuckles 22, 221 and proximal passages 24, 24' formed adjacent pin receiving bore 20 and pin 18, respectively. Adjacent proximal knuckles 22 and 22' are distal passages 28 and 28' respectively. Adjacent proximal passages 24 and 24' are distal knuckles 26 and 26', respectively.

The connector body halves 12 and 12' can be properly fitted together in only one orientation. Pin 18 is inserted into pin receiving bore 20 with the two halves at approximately right angles to each other relative to the central axis. The connector halves 12 and 12' are rotated relative to each other, thereby causing proximal knuckles 22 and 22' to enter and engage with proximal passages 24 and 24', respectively. Similarly, such rotation causes distal knuckles 26 and 26' to enter and engage with distal passages 28 and 28', respectively.

Figure 4:
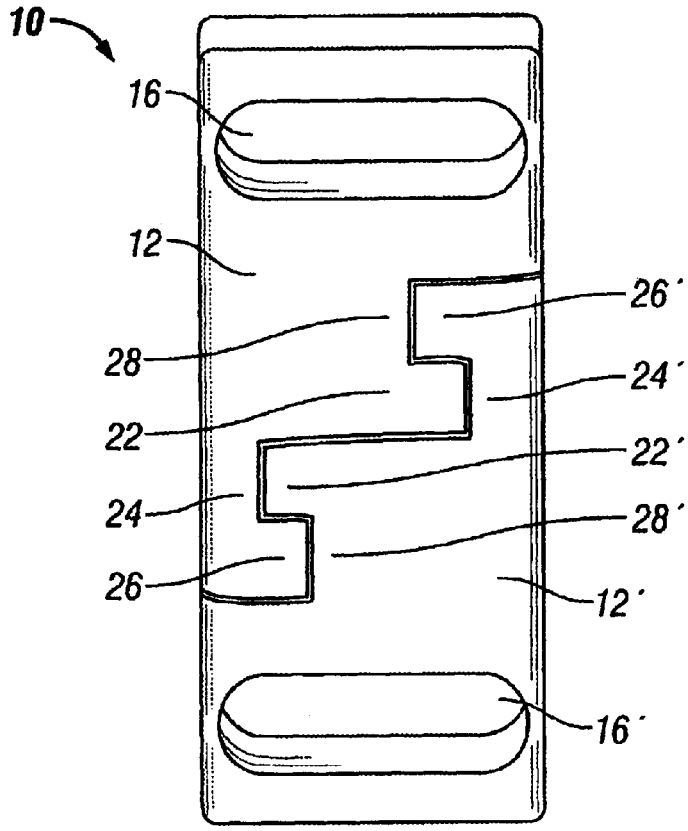
FIG. 4 is a plan view of the underside of the connector of FIG. 1.
Figure 5:
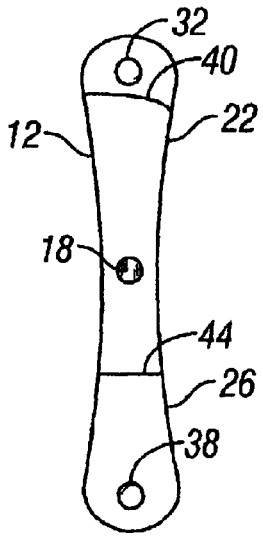
FIG. 5 is a view from the inner end of one of the body halves of the connector of FIG. 1, showing details of the coupling arrangement.

Proximal knuckles 22 and 22' have proximal knuckle faces 40 and 40', respectively, each being formed with an at least partially radiussed or curved surface. This is to permit rotational engagement of proximal knuckles 22 and 22' with proximal passages 40 and 40'. Proximal passages faces 42 and 42' are planar, as shown in FIGS. 4 and 5, in order to restrict complete rotation of connector body halves 12 and 12'.

In a similar manner, distal passages 28 and 28' have distal passage faces 46 and 46', respectively, wherein each distal passage face is shaped with an at least partially radiussed or curved planar cross section, to permit rotational engagement of distal knuckles 26 and 26' within distal passages 28 and 28'. Distal knuckle faces 44 and 44' are planar in cross section, in order to limit the rotation of connector body halves 12 and 12'.

Connector body halves 12 and 12' are considered to be in a fastened mode when proximal knuckle faces 40 and 40' contact proximal passage faces 42 and 42', respectively, and distal knuckle faces 44 and 44' contact distal passage faces 46 and 46', respectively.

Each connector body half 12, 12' contains a captive ball assembly 30 and 30'. Captive ball assembly 30 and 30' comprises a retaining bore 36 and 36' (not shown). These retaining bores 36, 36' contain springs 34, 34' (not shown) and balls 32, 32'. Balls 32 and 32' are restrained by swaging the opening of retaining bores 36, 36'. Spring 34 urges ball 32 outwardly to the opening of retaining bore 36.

The corresponding location on the other connector body half defines a receiving dimple or socket 38 or 38'. These receiving dimples 38, 38' engage balls 32, 32' of captive ball assemblies 30 and 30', respectively, in order to retain the connector body halves in a closed configuration.

What is claimed is:

1. A connector for strap members and the like comprising:

a body consisting of a pair of body halves, each body half including:

material forming an opening for the end of a member to be connected to the other body half;

a central longitudinal axis about which one body half may be rotated relative to the other body half to effect engagement or release of the two body halves in closing or opening the connector;

first and second transverse knuckle members terminating in end walls and first and second knuckle member receiving passages having inner walls aligned with the end walls of corresponding knuckle members of the other body half when the halves are connected together, the first and second transverse knuckle members being of different lengths with their end walls terminating on opposite sides of the central longitudinal axis and spaced therefrom by substantially the same distances as the inner walls of the corresponding knuckle member receiving passages of the other body half are spaced from said axis;

the inner walls of the first and second knuckle member receiving passages being displaced from the longitudinal axis on opposite sides thereof and further including transverse walls dimensioned to receive a corresponding knuckle member of the other body half; and means for aligning the two body halves along said central longitudinal axis to permit rotation thereof into a joined connector configuration.

2. The connector of claim 1 wherein each body half further includes a captive ball assembly and a corresponding receiving dimple to provide resistance to relative rotation of the two body halves when the body halves are connected.

3. The connector of claim 2 wherein said assembly comprises a retaining bore, a biasing spring, and a ball which is restrained within said assembly by swaging the opening of the retaining bore.

4. The connector of claim 3 wherein said captive ball assembly includes a spring biased to urge said ball against the dimensional limit of the swaged opening.

5. The connector of claim 1 wherein said aligning means comprise a pin in one of said body halves which is mounted along said central axis, and a bore in the other body half positioned along said central axis and adapted to receive said pin to guide rotation of the two body halves to a locked connection position.

6. The connector of claim 2 wherein each of the receiving dimples of opposing body halves is positioned to receive the ball of the captive ball assembly of the other body half when the two body halves are rotated into the connected position.

7. The connector of claim 1 wherein the end wall of at least one of said knuckle members is curved about a radius line of curvature aligned with said central longitudinal axis to accommodate relative rotation of the two body halves without interference from the other body half.

8. The connector of claim 7 wherein the inner wall of at least one of said knuckle message receiving passages is curved to accommodate relative rotation of the two body halves without interference.

9. The connector of claim 8 wherein the curvatures of the curved end wall of at least one knuckle member and the curved inner wall of the corresponding knuckle member receiving passage are shaped so as to permit connection of the two body halves with relative rotation thereof in only one direction.

10. The connector of claim 7 wherein the curvature of the end wall of at least one knuckle member is convex.

11. The connector of claim 9 wherein the curvature of the inner wall of at least one knuckle member receiving passage is concave.

12. The connector of claim 2 wherein the ball assembly in the face of one body half is aligned with the dimple in the face of the other body half when the two body halves are in a connected configuration.

13. A connector for strap members and the like comprising:

a body consisting of a pair of body halves configured to be joined or separated by rotating one body half with respect to the other body half about a central longitudinal axis, each body half comprising a solid portion and an open portion;

the shapes of the body halves being symmetrical along said central longitudinal axis to establish an interlocking configuration which accommodates joining the body halves along the central longitudinal axis with the two body halves at right angles to each other, followed by relative rotation of the two body halves about the central axis into an interlocked position;

and further including means for aligning the two body halves along said axis prior to joining the two together in an interlocked position;

wherein said aligning means comprise a central axial bore in one of said body halves and a central axial pin in the other body half, the bore being adapted to receive the pin to provide alignment of the two body halves along the central axis during relative rotation thereof.

14. The connector of claim 13 further including means for restraining the two body halves against relative rotation when the two halves are in the connected position.

15. The connector of claim 14 wherein the restraining means comprise at least one ball assembly and corresponding dimple in each of said body halves.

16. The connector of claim 15 wherein said ball assembly comprises a spring loaded ball retained in a bore by a swaged opening.

17. The connector of claim 13 wherein the symmetry of the two body halves is established by first and second knuckle members extending transversely to said central axis in said open position, wherein, the first and second knuckle members are separated by a first knuckle member receiving passage, and wherein the second knuckle member is separated from the solid portion of the body half by a second knuckle member receiving passage, said knuckle members and corresponding ones of said knuckle member receiving passages being established in interlocking relationship when the two body halves are in a connected position.

* * * * *